US009836960B2

(12) United States Patent
Bouillet et al.

(10) Patent No.: US 9,836,960 B2
(45) Date of Patent: Dec. 5, 2017

(54) DIAGNOSTIC SYSTEM, METHOD, AND RECORDING MEDIUM FOR SIGNALIZED TRANSPORTATION NETWORKS

(71) Applicant: International Business Machines Corporation, Armonk, NY (US)

(72) Inventors: Eric P. Bouillet, Englewood, NJ (US); Thanh Lam Hoang, Kildare (IE); Rahul Nair, Dublin (IE); Alessandra Pascale, Castleknock (IE)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/245,028

(22) Filed: Aug. 23, 2016

(65) Prior Publication Data

US 2017/0061786 A1 Mar. 2, 2017

Related U.S. Application Data

(63) Continuation of application No. 14/838,429, filed on Aug. 28, 2015, now Pat. No. 9,483,938.

(51) Int. Cl.
*G08G 1/01* (2006.01)

(52) U.S. Cl.
CPC ..... *G08G 1/0125* (2013.01); *G08G 1/0145* (2013.01)

(58) Field of Classification Search
CPC ... G08G 1/0125; G08G 1/0145; G08G 1/0133
See application file for complete search history.

(56) References Cited

U.S. PATENT DOCUMENTS

| | | | |
|---|---|---|---|
| 6,577,946 | B2 | 6/2003 | Myr |
| 7,698,055 | B2 | 4/2010 | Horvitz et al. |
| 7,840,427 | B2 | 11/2010 | O'Sullivan |
| 8,174,406 | B2 | 5/2012 | Kraft, IV et al. |
| 8,615,354 | B2 | 12/2013 | Barker et al. |
| 8,700,296 | B2 | 4/2014 | Chapman et al. |
| 8,706,459 | B2 | 4/2014 | Gupta et al. |
| 8,731,809 | B2 | 5/2014 | Koshizen |

(Continued)

FOREIGN PATENT DOCUMENTS

WO WO 2011/148222 A1 12/2011

OTHER PUBLICATIONS

Notice of Allowance in U.S. Appl. No. 14/838,429 dated Jul. 18, 2016.

(Continued)

*Primary Examiner* — Michael J Zanelli
(74) *Attorney, Agent, or Firm* — Kurt P. Goudy, Esq.; McGinn IP Law Group, PLLC

(57) ABSTRACT

A diagnosis system for an adaptive signal control system in a network, the diagnosis system including a traffic state identification device configured to estimate a traffic state describing a supply-demand mismatch by identifying a relationship between real time data feed from a sensor and a control strategy of said adaptive signal control system and a network transition model device configured to diagnose the supply-demand mismatch and an evolution of the supply-demand mismatch on a network level based on said relationship and infrastructure data of the network.

20 Claims, 8 Drawing Sheets

(56) References Cited

U.S. PATENT DOCUMENTS

| | | | | |
|---|---|---|---|---|
| 2011/0295626 | A1 | 12/2011 | Chen et al. | |
| 2013/0124073 | A1 | 5/2013 | Ren | |
| 2013/0197790 | A1 | 8/2013 | Ouali et al. | |
| 2013/0297211 | A1 | 11/2013 | Burr et al. | |
| 2014/0114556 | A1 | 4/2014 | Pan et al. | |
| 2014/0222321 | A1 | 8/2014 | Petty et al. | |
| 2014/0236449 | A1 | 8/2014 | Horn | |
| 2014/0368358 | A1 | 12/2014 | Xie | |
| 2014/0375475 | A1* | 12/2014 | Wongpiromsarn .... | G08G 1/083 340/907 |
| 2015/0102945 | A1 | 4/2015 | El-Tantawy | |
| 2016/0314686 | A1* | 10/2016 | Shi ..... | G08G 1/0116 |

OTHER PUBLICATIONS

Office Action in U.S. Appl. No. 14/838,429 dated May 9, 2016.
Kemp D et al: "Maximizing the spread of influence through a social network", Internet Citation, Aug. 5, 2003 (Aug. 5, 2003), XP003019043, Retrieved from the Internet: URL:http://www.cs.comell.edu/home/kleinber/kdd03-inf.pdf [retrieved on Jul. 1, 2007].
Gregoire, Jean et al. "Back-pressure traffic signal control with unknown routing rates." arXiv preprint arXiv: 1401.3357 (2013).
Gregoire, Jean et al. "Supplementary material to: Back-pressure traffic signal control with unknown routing rates." (2013).
SCOOT, Advice Leaflet 2: Congestion Management in SCOOT.

* cited by examiner

DIAGNOSTIC SYSTEM, METHOD, AND RECORDING MEDIUM FOR SIGNALIZED TRANSPORTATION NETWORKS

The present application is a Continuation application of U.S. patent application Ser. No. 14/838,429, filed on Aug. 28, 2015, the entire contents of which is incorporated herein by reference.

BACKGROUND

The present invention relates to an intelligent transportation system, method, and computer program product in signalized traffic systems, and more specifically, to a diagnosis tool for an adaptive signalized control system.

Signalized traffic systems are a fundamental section of an intelligent transportation system because they contribute to the management of congestion on an urban level. Signalized traffic systems are currently used in 154 cities in over 27 countries.

Conventionally, signalized traffic systems mostly refer to systems and methods for detecting traffic congestion. For example, some systems relate to integrating traffic, weather, incident, pavement condition, and roadway operational data to model and estimate traffic states for generating information for consumer and commercial utility. Accurate routing information for particular roadway segments are produced and the system provides a consumer with accurate, real-time traffic routing information integrating traffic, weather and congestion data.

However, the aforementioned signalized traffic systems main goal is to provide rerouting given the integration of all the inputs. The signalized traffic system requires a plurality of inputs in order to provide any meaningful output. This conventional system exhibits deficiencies by merely providing rerouting without any type of diagnosis of the event which caused the need to reroute.

Other signalized traffic systems relate generally to modeling traffic movement of a region, by running a traffic simulation based on at least one sensor model generated by selecting a subset of at least one traffic sensor. These systems use an information technology driven approach. Such techniques also increase supply side (roads, vehicles, etc.) and demand side (commuting needs) efficiency to overcome demand-supply mismatches, and make roads safer.

The above system takes input data from multiple sources and finds the optimal combination of different sensor types in order to satisfy a cost-benefit goal (in terms of accuracy, cost and coverage) for different traffic patterns. The system does not provide identification problems in signalized traffic control systems. Also, the proposed system requires the inputs from multiple data sources and requires a selection of a subset of the plurality of sensors.

Other systems utilize real-world data collected from transportation networks to incorporate the data's intrinsic behavior into a time-series mining technique to enhance its accuracy for traffic prediction. For example, systems use the spatio-temporal behaviors of rush hours and events for better prediction by taking historical rush-hour behavior into account to improve the accuracy of traditional predictors.

This conventional system seeks to improve prediction accuracy of a basic time series model (ARIMA) with a hybrid approach to include the impact of incidents directly detected from sensors in real time to enhance predictions. However, the ARIMA model is used for a regression problem, and therefore, the proposed system cannot predict discrete events, for example, congestion propagation. That is, conventional systems merely identify congestion of the systems but fail to identify problems within the systems and how the problems throughout the systems.

More recently, there has been proposed signalized traffic systems relating to a ground transportation network matching individuals with transportation capacity on a supply and demand basis. The systems utilize an active monitoring system for generation of traffic flow data; combined with a central information repository, to provide real time network for traffic flow throughout a metropolitan area along with enabling any of the Transport Capacity vehicles to act as "traffic probes" reporting on throughput and delays in traffic. Other recent systems have proposed a traffic information gathering system using cellular phone networks for automated intelligent traffic signal control where location information is obtained and continuously updated from vehicle-based cellular phones. The system processes the information and uses the information as an input to Real Time Urban Traffic Guidance for Vehicular Congestion and Intelligent Traffic Control Systems.

SUMMARY

However, the recent signalized traffic systems focus primarily on public transportation services where the demand (travelers) needs to be matched with the supply (seats). The concept of a demand-supply matching of a public transport system does not address analyzing a network as a whole where the demand includes the number of vehicles that would like to use the urban network, and the supply of a set of resources (i.e., green time, phase time, traffic light plan, etc.) used by the control system to serve the demand. Also, data collected by probes (e.g. GPS data, cellular data) as inputs only relates to providing additional inputs to an existing signalized traffic systems that detects traffic congestion. The recent systems fail to evaluate and diagnose existing traffic networks and completely ignore updating the supply side of the traffic network.

Conventionally, real-time diagnosis of a system at a network wide level (i.e., city-wide level) is challenging due to a high degree of dependency and system uncertainty. It is non-trivial to diagnose which section of the network is originally causing the congestion that propagates throughout the system due to the system uncertainty caused by non-stationary and unstable traffic processes. In conventional data networks, the destination and routes of packets are known. However, in a signalized transportation network, destination of vehicles and the unpredictability of human actions result in the supply-demand mismatches being non-trivial to identify. The present inventors have recognized that conventional techniques for intelligent transportation system in signalized traffic systems have a number of problems and that improvements would be beneficial.

For example, FIG. 5 shows a free flow state in which there are no supply-demand mismatches at detector locations during normal operation, as shown at reference numeral 501. Also, FIG. 5 shows a congestion state in which the system is oversaturated and unstable such that increase in supply does not serve additional demand. as shown at reference numeral 502. Further, FIG. 5 shows conventional network effects of not understanding the downstream effects of signal control as network effects, as shown at reference number 503. That is, sub-optimal supply conditions due to network-effects occur in two cases. First, there is a penalty for coordination if the sensors is inefficient because the system is "over-correcting". Second, there is a capacity loss if the system is misconfigured.

According to an exemplary embodiment of the present invention, the present inventors have recognized an evaluation and diagnosis system that identifies the supply-demand mismatches over a signalized network to diagnose if there if there are misconfigurations within the network and predicts and estimates the spatio-temporal propagation of the misconfigurations through the network.

Accordingly, it is an exemplary feature of the invention to provide a diagnosis system for an adaptive signal control system, the diagnosis system including a traffic state identification device configured to estimate a traffic state describing the supply-demand mismatch by identifying a relationship between real time data feed from sensors and a control strategy of said adaptive signal control system and a network transition model device configured to diagnose supply-demand mismatches and an evolution of the supply-demand mismatches on a network level based on said relationship and infrastructure data of a network.

DETAILED DESCRIPTION

Figure 1:
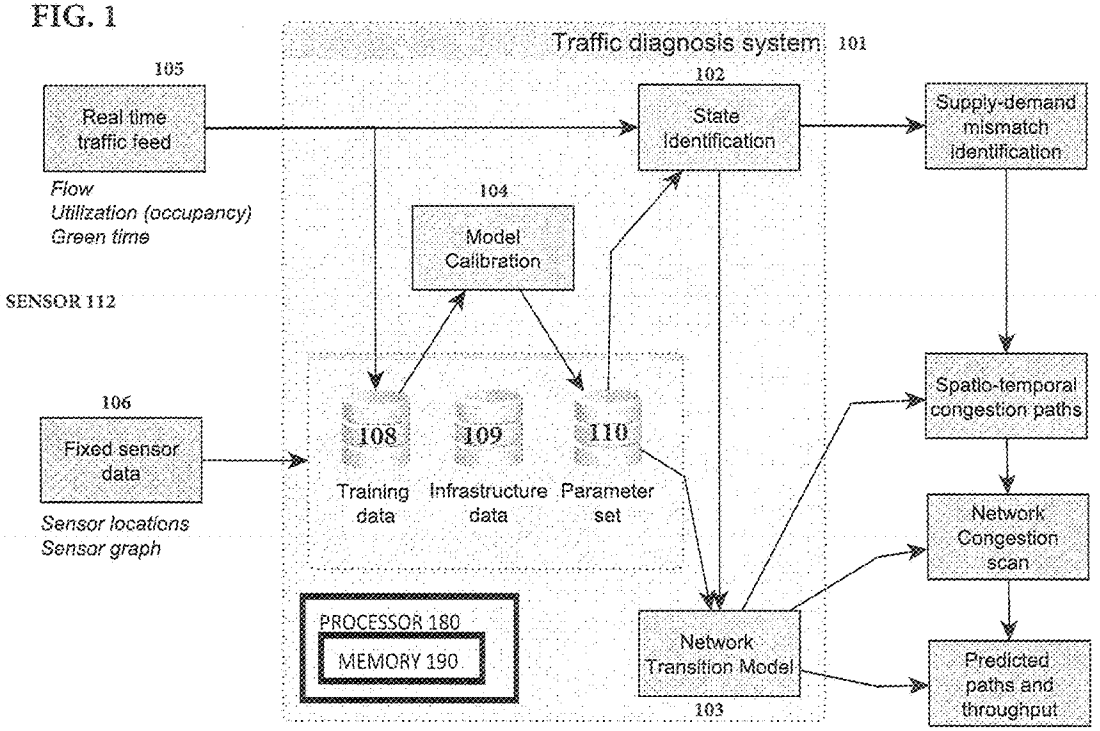
FIG. 1 exemplarily shows a block diagram illustrating a configuration of a traffic control system according to an exemplary embodiment of the present invention.
Figure 2A:
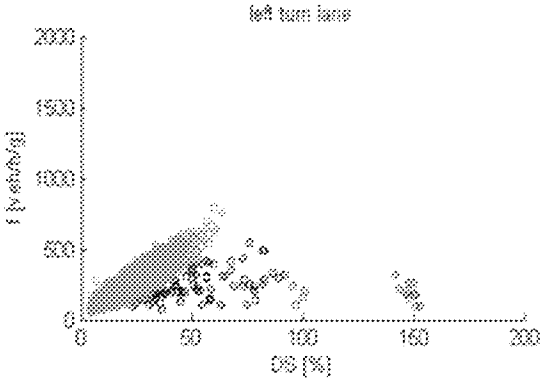
FIG. 2(*a*)-2(*d*) exemplarily show state classification graphs.
Figure 2B:
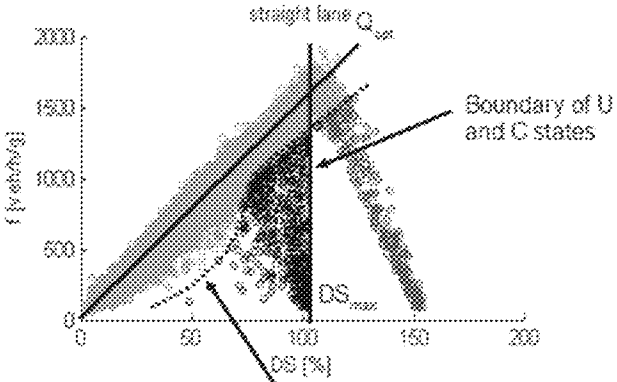
Figure 2C:
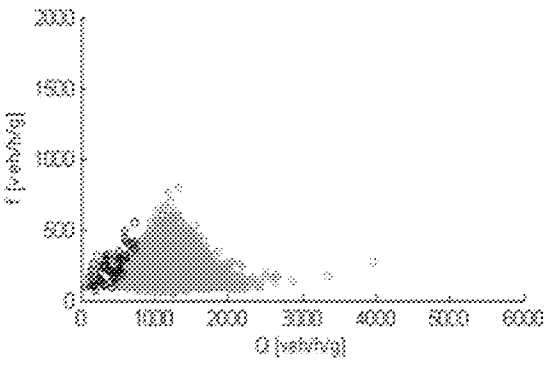
Figure 2D:
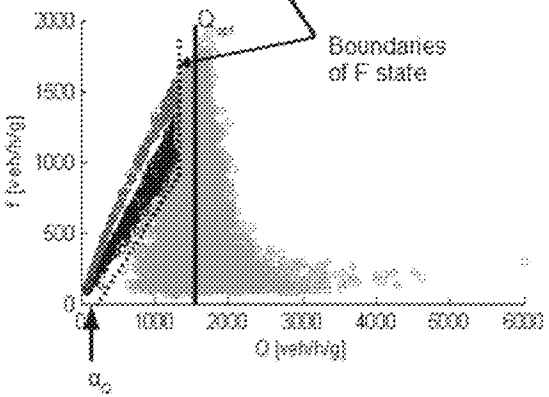

With reference now to FIG. 1, the traffic diagnosis system 101 comprises a traffic state identification device 102, a network transition model device 103, a model calibration device 104, a training data device 108, an infrastructure data device 109, and a parameter set device 110. The traffic diagnosis system includes a processor 180 and a memory 190, the memory 190 storing instructions to cause the processor 180 to execute each device of the traffic diagnosis system 101.

The traffic control system 101 receives inputs from the real time traffic feed data device 105 and inputs from the fixed sensor data device 106.

Fixed sensor data of the fixed sensor data device 106 is collected by sensors 112 installed at various locations on an urban network. The sensors 112 are previously installed in a pre-existing signalized transportation network and the fixed sensor data device 106 collects the fixed sensor data from the sensors 112 at their current locations. In this manner, the traffic diagnosis system 101 can be adapted to diagnose and evaluate a pre-existing signalized transportation network in an urban network.

The fixed sensor data device 106 inputs fixed sensor data for a location of each sensor of the sensors 112 installed at various locations on the urban network to the training data device 108, the infrastructure data device 109, and the parameter set device 110. The fixed sensor data is stored for each sensor in the infrastructure data device 109. The fixed sensor data includes a location of the sensors 112. The fixed sensor data includes topology of the urban network which is stored in the infrastructure data device 109. The topology is updated according to the fixed sensor data collected over time.

It should be noted that the topology of the urban network can change over time. For example, certain directional turns in particular lanes are not allowed during certain times of the day or contraction can occur and cause a change in the topology of the network. Also, additional lanes can be added to change the topology of the network. The topology of the network is input and stored in the infrastructure data device 109 by the fixed sensor data device 106.

Demand variables are calculated by the sensors and input into the traffic diagnosis system 101 by the real time traffic feed data device 105. The demand variables may include how many vehicles would like to use the transport network.

Supply variables are input into the traffic diagnosis system 101 by the real time traffic feed device. The supply variables may include how the control strategy and signal control actions (i.e., changing of traffic signals) for the signalized transportation network are being rationed to serve the demand Signal control actions and control strategy include, for example, the green time of traffic control signals, offsets of traffic control signals between joining intersections and how the green times of joining intersections are combined, splits of traffic control signals which partition how phases of green lights are designed to serve the demand, and the cycles of the traffic control signals. The signal control actions are not limited to the aforementioned exemplary control actions but the supply variables discussed herein are intended to include any control strategy and signal control actions for a signalized transportation network. It is noted that the present invention is described in the context of conventional red-yellow-green traffic. However, the invention can be tailored to other traffic control system (i.e., the color indicating traffic may be changed).

The real time traffic feed data device 105 may include real time traffic feed data collected by the sensors 112 as variables of the flow, utilization, and control strategies (i.e., green times) at a stop line near the of the traffic control signals. A stop line is commonly known as the line near the traffic control signal that the vehicles stop and wait for the traffic control signal to change colors.

The traffic state identification device 102 receives the real time traffic feed data from the real time traffic feed data device 105 and identifies a traffic state classification for each sensor of the sensors 112. The traffic state identification device 102 diagnoses a relationship between the real time traffic feed data and a control strategy of the network as a traffic state classification.

FIGS. 2(*a*)-(*d*) show a traffic state classification by the traffic state identification device 102 according to an exemplary embodiment of the claimed invention. The traffic state classifications of FIGS. 2(*a*)-(*d*) are calculated by:

$$s(f, DS, Q) = \begin{cases} U, & \text{if } f > Q - \alpha_Q \text{ and } Q < Q_{opt} - \sigma_Q \text{ and } DS < DS_{max}, \\ C, & \text{if } f > Q - \alpha_Q \text{ and } Q < Q_{opt} - \sigma_Q \text{ and } DS \geq DS_{max}, , \\ F, & \text{otherwise.} \end{cases}$$

where, $\sigma_Q$ and $\alpha_Q$ are computed with the standard deviation of the capacity, Q is the capacity, $Q_{opt}$ is the optimal capacity, $DS_{max}$ is the Demand Served (DS) that corresponds to the maximum flow, U is a yellow state classification, C is a red state classification, and F is a green state classification.

As shown in FIG. 2(*b*), the traffic state identification device 102 identifies a green state classification (free flow F), a red state classification (congestion C), or a yellow state classification (under-utilized U) based on the real time traffic feed.

FIG. 2(*b*) shows a green state classification (free flow F) which occurs when, as DS increases, there is an increase in throughput and the traffic light at that particular sensor works at the optimal service rate. FIG. 2(*b*) further shows a red state classification (congestion C) which occurs as DS grows, flow served decreases, and the traffic light at that particular sensor works in oversaturated (unstable) condition. FIG. 2(*b*) further shows a yellow state classification (under-utilized U) which occurs as DS grows, in which flow served does not increase leading to under-utilized green times.

If the traffic state identification device 102 identifies a sensor as having the green state classification, then that particular sensor is deemed to be working at the optimal service rate. If the traffic state identification device 102 identifies a sensor as having the red state classification, then that particular sensor is in a congested state and the congestion is propagating in the system. A red state classification indicates a system malfunction and the system is not operating properly. If the traffic state identification device 102 identifies a sensor as having the yellow state classification, then that particular sensor is not serving the demand such that even if the green time was increased, the increase in supply served would not occur.

The traffic state identification device 102 identifies the traffic state classification in non-stationary, noisy, detector time series.

Based on the traffic state classification, the traffic state identification device 102 identifies a location (i.e., which specific sensor location) and a severity of a mismatch in the supply-demand of the adaptive control system. For example, a red state indicates a severe mismatch between the vehicles that want to use the network and the current supply of traffic signals.

The network transition model device 103 receives the traffic state classification from the traffic state identification device 102 for each of the sensors 112 and the location and the severity of the mismatch in the supply-demand of the adaptive control system.

The network transition model device 103 identifies a location of propagation paths and congestion hubs within the network based on the location and severity of the mismatch in supply-demand of the adaptive control system previously identified and the fixed sensor data received from fixed sensor data device 106. The network transition model device 103 identifies the location of propagation paths and congestion hubs within the network in real-time.

The network transition model device 103 further identifies a loss or a gain in vehicle throughput over predetermined paths based on the location of propagation paths and congestion hubs within the network and the location and severity of the mismatch in supply-demand in the adaptive control system previously identified.

The network transition model device 103 predicts propagation paths in the network and future congestion scans based on the identified location of propagation paths and the congestion hubs within the network.

Further, the network transition model device 103 identifies the frequency of congestion hubs and the frequency of the propagation paths while offline. That is, the training data device 108 stores the real time traffic feed data as historical data for offline evaluation that may be performed by the model calibration device 104. Based on the historical real time traffic feed data stored in the training data device 108 and the infrastructure data of the infrastructure data device 109, the model calibration device 104 generates a set of parameters for the system to increase the efficiency of the supply of the control signal strategy and network. The set of parameters are stored in the parameter set device 110. The set of parameters are updated at predetermined times. The state identification device 102 and the network transition model device 103 utilize the set of parameters stored in the parameter set device to identify, with better accuracy since data is updated over time, the exact locations of mismatches in supply-demand In other words, the diagnosis system is able to identify the particular sensor with the frequent congestion hubs and frequent propagation paths as more real time traffic feed data is collected and stored in the training data device 108 to be used by the model calibration device 104 in order to set additional parameters for the system.

For example, the model calibration device 104 learns the optimal service rate at a particular sensor based on the real time feed data stored in the training data device 108. The model calibration device 104 stores the optimal service rate at the particular sensor as a parameter to be stored in the parameter set device 110 and as a parameter to be used by the network transition model device 103.

Also, the traffic state identification device 102 stores the traffic state classification for each sensor of the sensors 112 according to a time of day and with the infrastructure data of the infrastructure data device 109 as a parameter in the parameter set device 110. Also, after the green state classification (free flow F), the red state classification (congestion C), and the yellow state classification (under-utilized U) based on the real time traffic feed are identified by the traffic state identification device 102, the state is stored as a parameter for the system in the parameter set device 110.

Further, the parameter set device 108 stores a probability that supply-demand mismatches (i.e., congestion) will propagate from one sensor to a second sensor within the system as another parameter. The probability that supply-demand mismatches will propagate from one sensor to the second sensor is learned from historical data stored in the training data device 108. The model calibration device 104 uses the parameter of probabilities of supply-demand mismatches to train the control strategy and signal control actions for the signalized transportation network to be better rationed to serve the demand.

Each parameter of the parameter set device 110 is updated at a particular frequency based on the system's need.

The diagnosis system 101 diagnoses the location and severity of supply-demand mismatches, identifies a location of propagation paths and congestion hubs within the network, identifies a loss or a gain in vehicle throughput over predetermined paths, and predicts propagation paths in the network and future congestion scans. An existing urban signalized transportation network can implement these outputs of the diagnosis system 101 to train the control strategy and signal control actions for the existing signalized transportation network to be better rationed to serve the demand.

Figure 3:
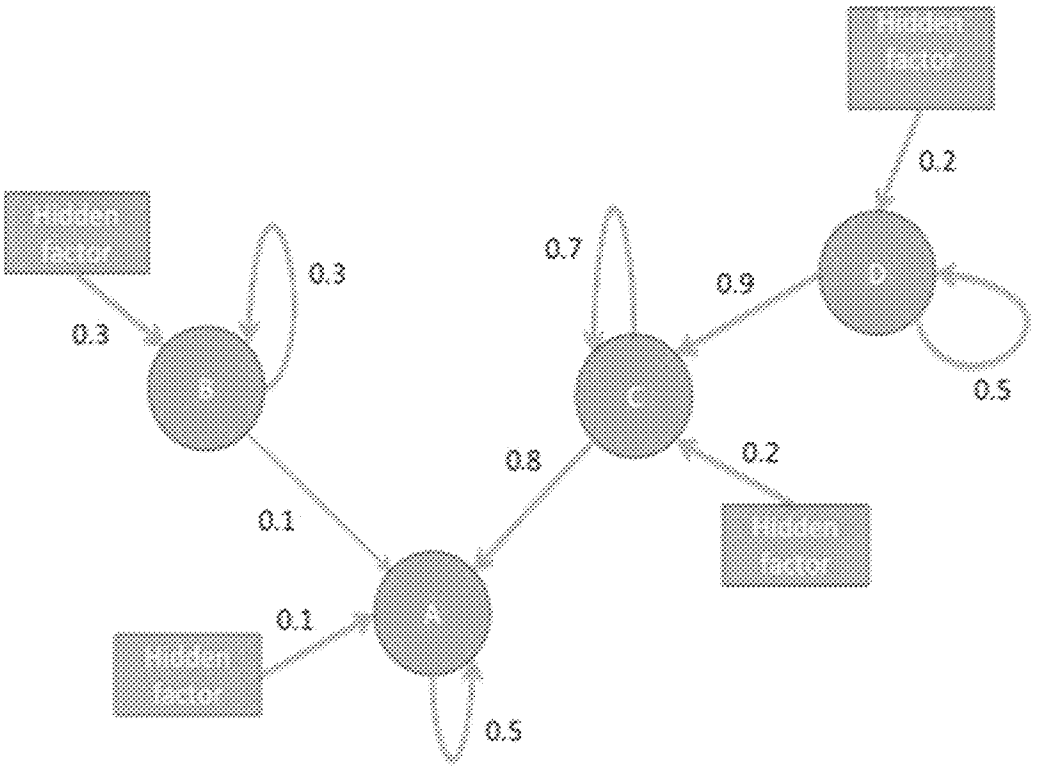
FIG. 3 exemplarily shows a network transition model using a dynamic cascade model.

Referring to FIG. 3, the diagnosis system 101 utilizes a dynamic cascade model for spatio-temporal networks to calculate the above outputs. The traffic state classifications by the traffic state identification device 102 are input into the network transition model device 103 which uses the dynamic cascade model.

The dynamic cascade model includes nodes (shown in FIG. 3 as A, B, C, D) as the sensors 112. Each node may includes hidden factor(s) that affect only that particular node. Hidden factors may include, for example, a traffic accident, a vehicle not utilizing a green time, or human behavior to inhibit the flow of traffic. Hidden factors may include any factor that cannot be predicted based on the control strategy. Each sensor includes edge calculations for a self-edge calculation of the node, hidden factor edge calculation to the node, and an edge calculation from a downstream sensor to an upstream sensor. On every edge, a probability is learned as a parameter to be stored in the parameter set device 110 indicating the probability that congestion will propagate from that node through the system. The dynamic cascade model assumes that propagation along one edge is independent from the other edges.

For example, the probability calculated between nodes C to A in FIG. 3 is "0.8" represents the likelihood that congestion will occur at node A as a result of the control signal of node C. Also, there is a "0.1" probability that congestion will occur at node A as a result of the control signal of node B. Therefore, the calculation by the dynamic cascade model shows that it is more likely that congestion at A is caused by node C than by node B. Further, the 0.5 probability at node A indicates the likelihood of a particular state occurring at node A. That is, the model predicts that the probability that the same state or a different state will occur at node A. The hidden factor probability of "0.1" at node A represents the unknown effects in the system and taking into account items that are not able to be easily predicted. The hidden factors are not caused by the traffic control system.

These probabilities between each node can be calculated in the dynamic cascade model using the historical real time traffic feed data stored in the training data device 108 and each probability is stored as a parameter in the parameter set device 110.

As can be seen from FIG. 3, the dynamic cascade model used in the network transition model device 103 is also able to output, in real-time, the source of congestion, most likely congestion paths, and predict the next propagation path. The cascade model is able to identify the root of the congestion from a particular node and how likely the congestion will propagate to a different node.

Further, the diagnosis system 101 uses the outputs from the dynamic cascade model to identify and evaluate the critical locations of supply-demand mismatches and the frequency of congestion propagation paths based on the probabilities calculated while the system is offline.

The probabilities calculated in the dynamic cascade model enable the network transition model device 103 to identify the real-time locations of propagation paths and congestion hubs, identify the loss and the gain in vehicle throughput over specified paths, and uses the probabilities to predict propagation paths and future congestion scans between nodes.

Figure 4:
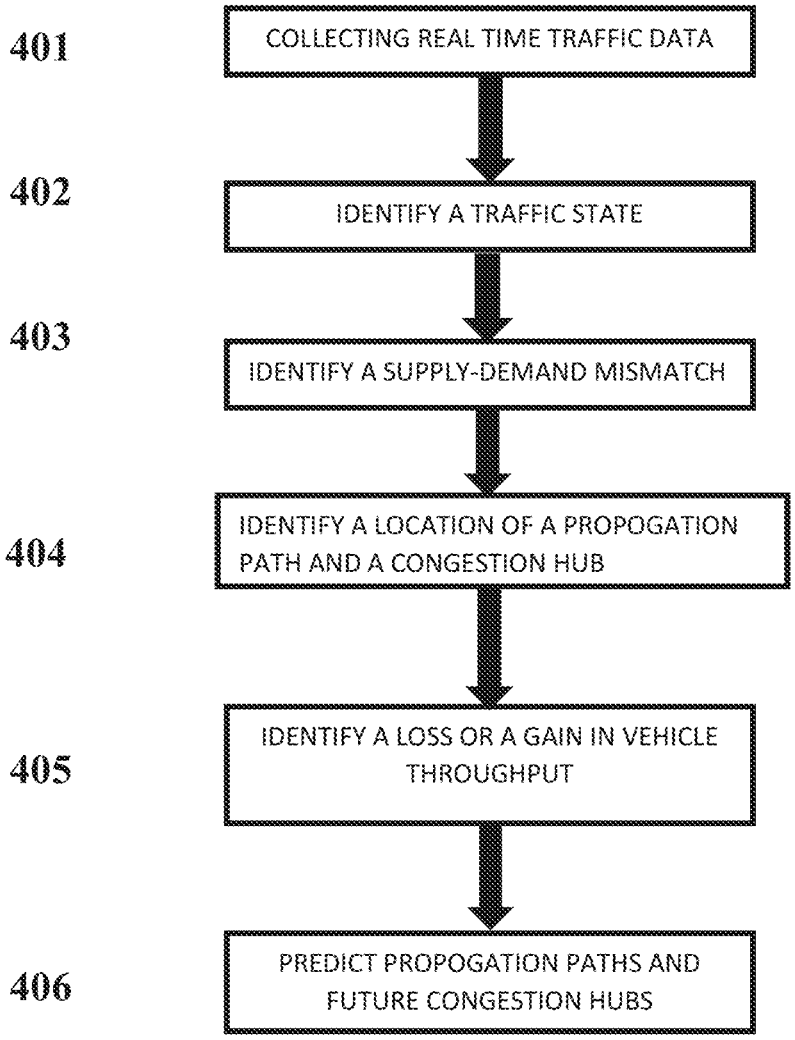
FIG. 4 exemplarily shows a flow chart for a diagnostic method for signalized transportation networks.
Figure 5:
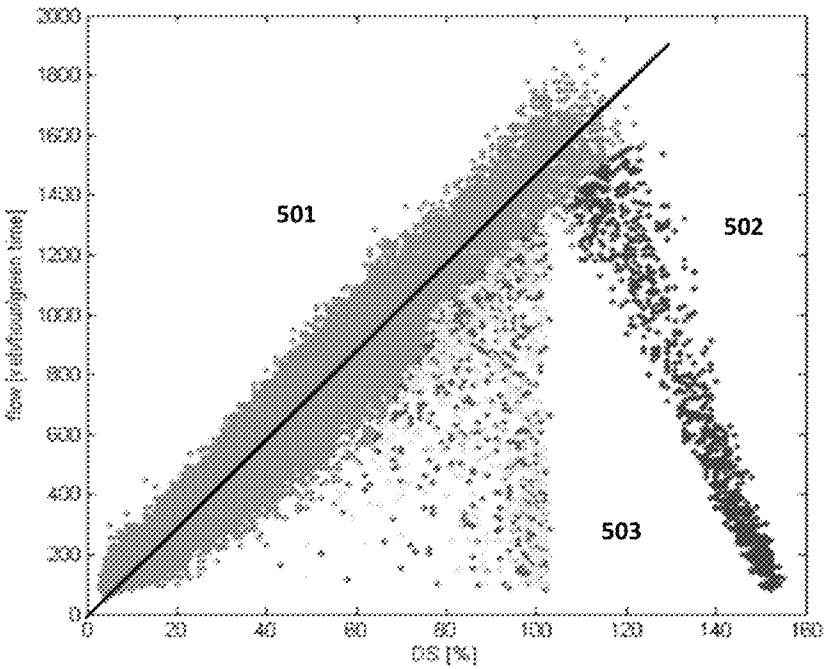
FIG. 5 exemplary shows a graph of conventional traffic state classification on the flow served vs. efficiency.

FIG. 4 shows a high level flow chart for a diagnostic method 400 for signalized transportation networks.

Step 401 collects real time traffic feed data and step 402 identifies a traffic state classification for each sensor of the sensors 112 based on the real time traffic feed data 105.

Step 403 identifies a location (i.e., which sensor) and a severity of a mismatch in the supply-demand of the adaptive control system based on the traffic state classification of step 402.

Step 404 identifies a location of propagation paths and congestion hubs (i.e., evolution) within the network in real-time based on the location and severity of the mismatch in supply-demand of the adaptive control system previously identified in step 403 and the real time traffic feed data in step 401.

Step 405 identifies a loss or a gain in vehicle throughput over predetermined paths based on the location of propagation paths and congestion hubs within the network of step 404 and the location and severity of the mismatch in supply-demand in the adaptive control system previously identified in step 403.

Step 406 predicts propagation paths in the network and future congestion scans based on the identified location of propagation paths and the congestion hubs within the network in step 404.

Exemplary Hardware Aspects, Using a Cloud Computing Environment

It is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Figure 6:
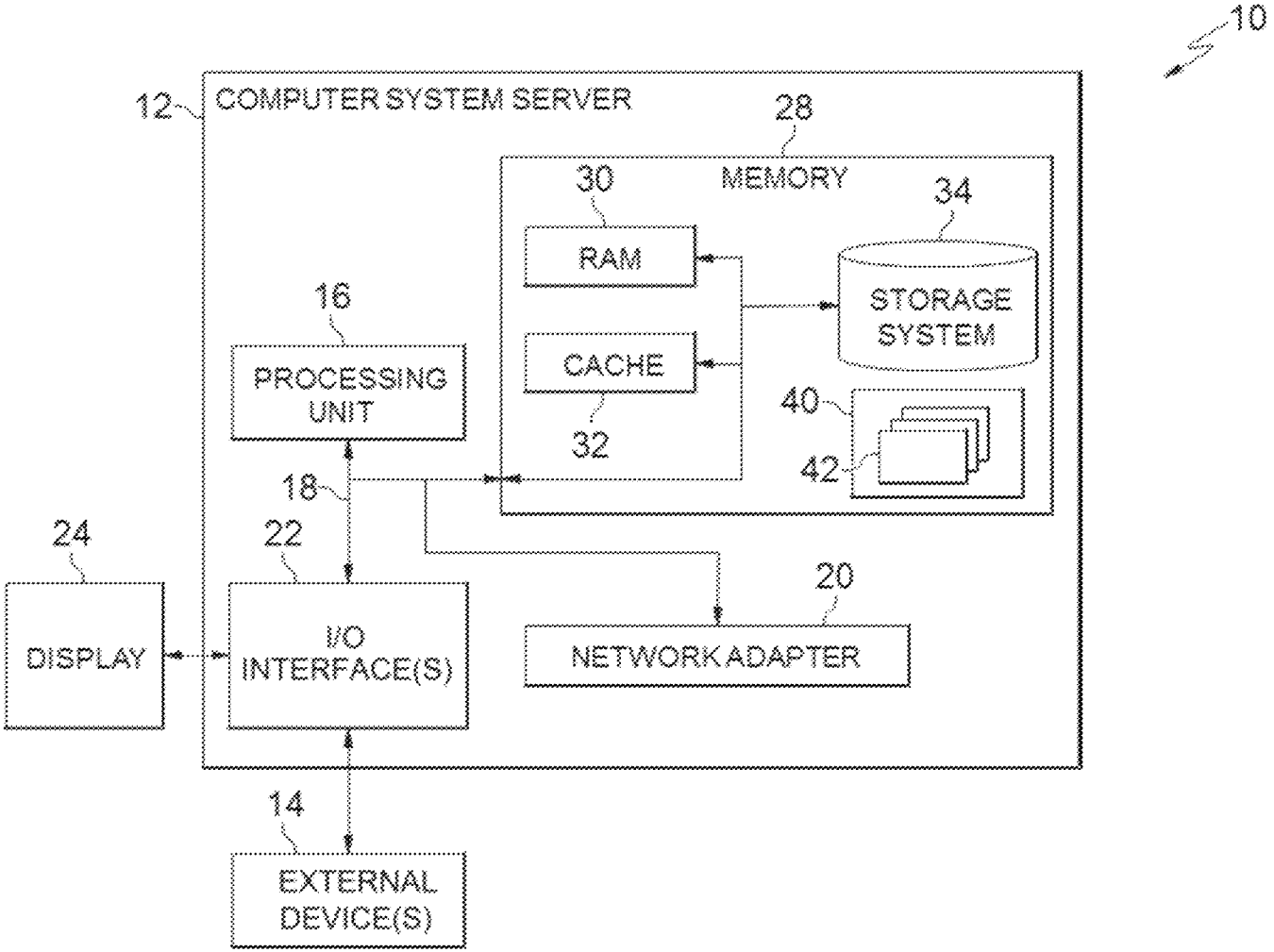
FIG. 6 depicts a cloud computing node according to an embodiment of the present invention.

Referring now to FIG. 6, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 6, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 7:
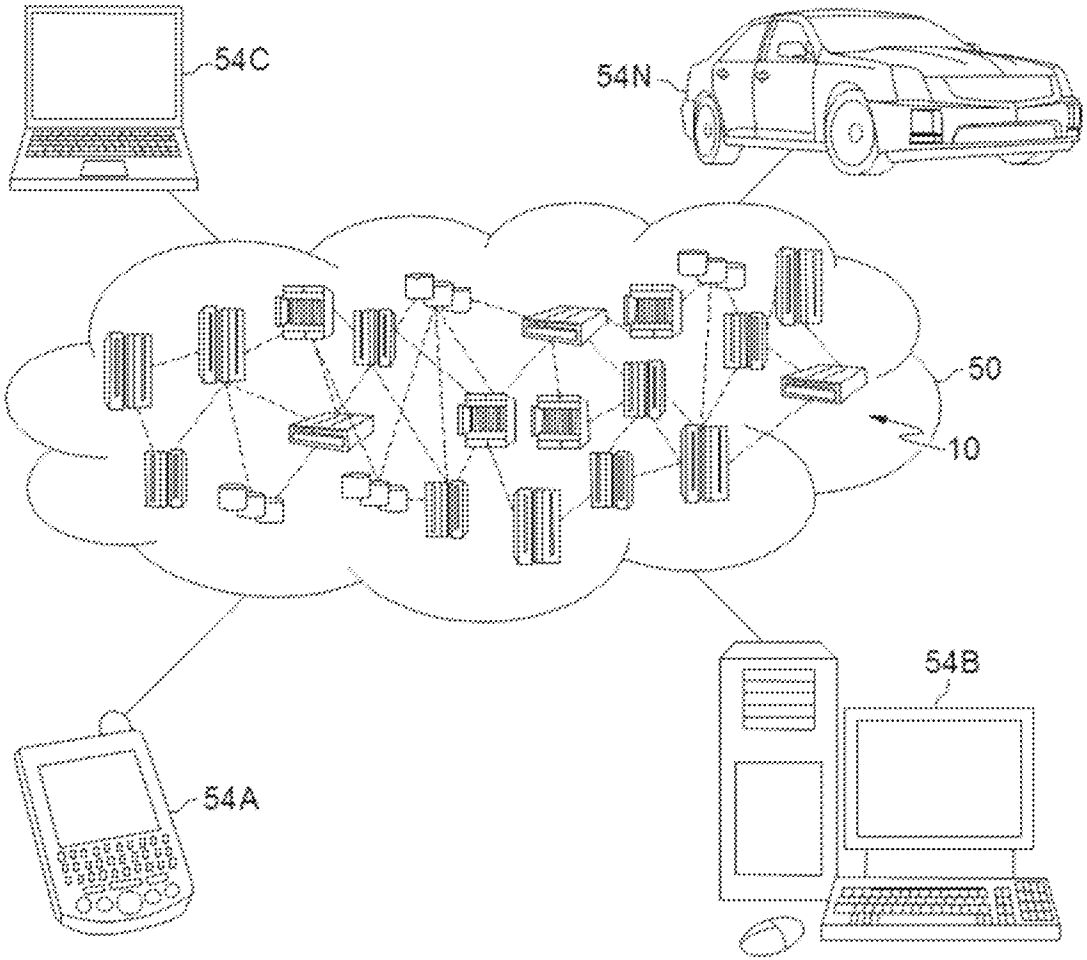
FIG. 7 depicts a cloud computing environment according to an embodiment of the present invention.

Referring now to FIG. 7, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 7 are intended to be illustrative only and that computing nodes 10 and cloud computing environment 50 can communicate with any type of computerized device over any type of network and/or network addressable connection (e.g., using a web browser).

Figure 8:
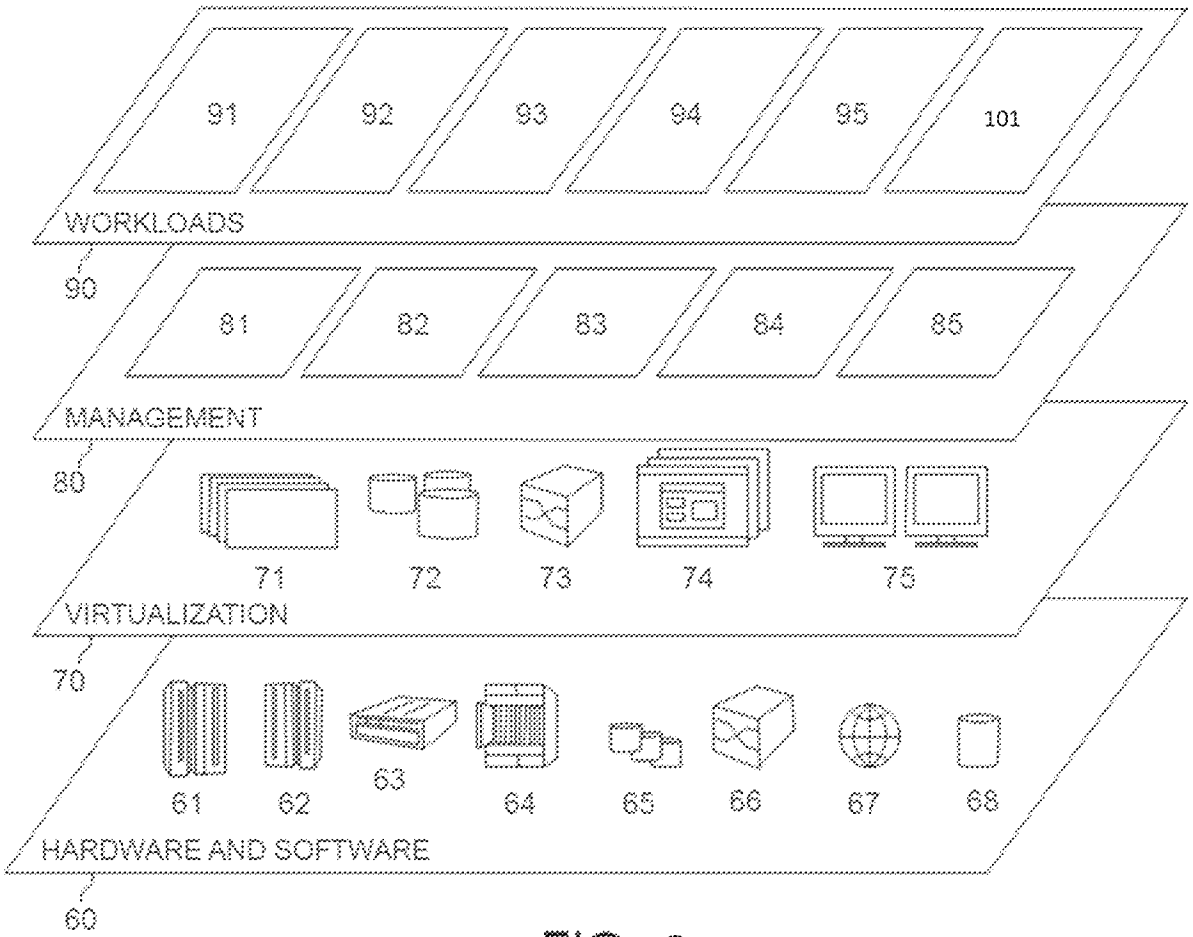
FIG. 8 depicts abstraction model layers according to an embodiment of the present invention.

Referring now to FIG. 8, a set of functional abstraction layers provided by cloud computing environment 50 (FIG. 7) is shown. It should be understood in advance that the components, layers, and functions shown in FIG. 8 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and, more particularly relative to the present invention, the traffic diagnosis system 101 described herein.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Further, Applicant's intent is to encompass the equivalents of all claim elements, and no amendment to any claim of the present application should be construed as a disclaimer of any interest in or right to an equivalent of any element or feature of the amended claim.

What is claimed is:

1. A diagnosis system for an adaptive signal control system in a network, said system comprising:

a processor; and a memory, the memory storing instructions to cause the processor to:

estimate a traffic state by identifying a relationship between real time data feed from a plurality of sensors and a control strategy of said adaptive signal control system;

store a probability that a supply-demand mismatch of the traffic state will propagate from a first sensor to a second sensor; and train the control strategy of the adaptive signal control system to adjust signal control actions to reduce the probability that the supply-demand mismatch will propagate from the first sensor to the second sensor.

2. The diagnosis system according to claim 1, wherein the memory further stores instructions to cause the processor to:

diagnose a location and a severity of supply-demand mismatches;

identify a location of propagation paths and congestion hubs within the network based on the probability that the supply-demand mismatch of the traffic state will propagate from the first sensor to the second sensor;

identify a loss or a gain in a throughput over the propagation paths; and predict propagation paths in the network at a different location.

3. The diagnosis system according to claim 1, wherein the memory further stores instructions to cause the processor to diagnose the supply-demand mismatch of the traffic state and an evolution of the supply-demand mismatch on a network level based on said relationship and infrastructure data of the network.

4. The diagnosis system according to claim 3, wherein the memory further stores instructions to cause the processor to predict a future evolution of the supply-demand mismatch on the network level based on an identified loss or an identified gain in a throughput over the predetermined path.

5. The diagnosis system according to claim 3, wherein the diagnoses uses a dynamic cascade model to diagnose the supply-demand mismatch and the evolution of the supply-demand mismatch on the network level.

6. The diagnosis system according to claim 1, wherein the memory further stores instructions to cause the processor to identify a loss or a gain in a throughput over a predetermined path based on the diagnosed supply-demand mismatch and an evolution of the supply-demand mismatch.

7. The diagnosis system according to claim 1, wherein the memory further stores instructions to cause the processor to estimate a severity and a location of the traffic state describing the supply-demand mismatch for each sensor of the sensor disposed in the adaptive signal control system.

8. The diagnosis system according to claim 1, wherein the memory further stores instructions to cause the processor to:

store the probability on a training data device configured to store real time feed data; and learn a parameter set at each sensor of the sensors to increase an efficiency of the control strategy of said adaptive signal control system based on the real time feed data stored in the training data device and the infrastructure data.

9. The diagnosis system according to claim 8, wherein the parameter set at each sensor is learned while the diagnosis system is offline.

10. The diagnosis system according to claim 1, wherein the memory further stores instructions to cause the processor to identify a frequency of the supply-demand mismatch and a frequency of an evolution of the supply-demand mismatch on the network level.

11. The diagnosis system according to claim 1, embodied in a cloud-computing environment.

12. A computer-implemented diagnosis method for an adaptive signal control system of a network, said diagnosis method comprising:

estimating a traffic state by identifying a relationship between real time data feed from a plurality of sensors and a control strategy of said adaptive signal control system;

storing a probability that a supply-demand mismatch of the traffic state will propagate from a first sensor to a second sensor; and training the control strategy of the adaptive signal control system to adjust signal control actions to reduce the probability that the supply-demand mismatch will propagate from the first sensor to the second sensor.

13. The computer-implemented method of claim 12, further comprising:

diagnosing a location and a severity of supply-demand mismatches;

identifying a location of propagation paths and congestion hubs within the network based on the probability that the supply-demand mismatch of the traffic state will propagate from the first sensor to the second sensor;

identifying a loss or a gain in a throughput over the propagation paths; and predicting propagation paths in the network at a different location.

14. The computer-implemented method of claim 12, further comprising diagnosing the supply-demand mismatch of the traffic state and an evolution of the supply-demand mismatch on a network level based on said relationship and infrastructure data of the network.

15. The computer-implemented method of claim 12, further comprising identifying a loss or a gain in a throughput over a predetermined path based on the diagnosed supply-demand mismatch and an evolution of the supply-demand mismatch.

16. The computer-implemented method of claim 12, embodied in a cloud-computing environment.

17. A computer program product for a diagnosis program for an adaptive signal control system in a network, the computer program product comprising a computer-readable storage medium having program instructions embodied therewith, the program instructions executable by a computer to cause the computer to perform:

estimating a traffic state by identifying a relationship between real time data feed from a plurality of sensors and a control strategy of said adaptive signal control system;

storing a probability that a supply-demand mismatch of the traffic state will propagate from a first sensor to a second sensor; and training the control strategy of the adaptive signal control system to adjust signal control actions to reduce the probability that the supply-demand mismatch will propagate from the first sensor to the second sensor.

18. The computer program product of claim 17, further comprising:

diagnosing a location and a severity of supply-demand mismatches;

identifying a location of propagation paths and congestion hubs within the network based on the probability that the supply-demand mismatch of the traffic state will propagate from the first sensor to the second sensor;

identifying a loss or a gain in a throughput over the propagation paths; and predicting propagation paths in the network at a different location.

19. The computer program product of claim 17, further comprising diagnosing the supply-demand mismatch of the traffic state and an evolution of the supply-demand mismatch on a network level based on said relationship and infrastructure data of the network.

20. The computer program product of claim 17, further comprising identifying a loss or a gain in a throughput over a predetermined path based on the diagnosed supply-demand mismatch and an evolution of the supply-demand mismatch.

* * * * *